US005737843A

United States Patent [19]

Fringer et al.

[11] Patent Number: 5,737,843

[45] Date of Patent: Apr. 14, 1998

[54] UNIVERSAL DEVICES FOR PROTECTING THE USER OF A CIRCULAR SAW FROM FLYING DEBRIS

[76] Inventors: Morris A. Fringer, 430 W. Northcreek Rd., Smyrna, Tenn. 37167; Daniel L. Fringer, 1784 W. Northfield Blvd., Suite 161, Murfreesboro, Tenn. 37129

[21] Appl. No.: 743,455

[22] Filed: Oct. 3, 1996

[51] Int. Cl.[6] ..... B25F 5/02

[52] U.S. Cl. ..... 30/391; 30/390

[58] Field of Search ..... 30/390, 514, 516, 30/124, 128, 391, 286

[56] References Cited

U.S. PATENT DOCUMENTS

| | | | |
|---|---|---|---|
| 1,525,723 | 2/1925 | Davis | 30/390 |
| 1,830,579 | 11/1931 | Wappat | 30/391 |
| 2,795,248 | 6/1957 | Doerner | 30/286 |
| 3,177,909 | 4/1965 | Laube et al. | 30/391 |
| 3,513,888 | 5/1970 | Townsend et al. | 30/390 |
| 3,662,796 | 5/1972 | Batistelli | 30/390 |
| 3,727,655 | 4/1973 | Garcher | 30/514 |
| 4,414,743 | 11/1983 | Pioch et al. | 30/390 |
| 4,466,187 | 8/1984 | Morimoto | 30/390 |
| 4,675,999 | 6/1987 | Ito et al. | 30/390 |
| 4,856,394 | 8/1989 | Clowers | 30/390 |
| 5,007,173 | 4/1991 | Rush | 30/391 |
| 5,033,192 | 7/1991 | Franz et al. | 30/390 |
| 5,046,255 | 9/1991 | Lebreux | 30/286 |
| 5,159,759 | 11/1992 | Fringer | 30/390 |
| 5,235,753 | 8/1993 | Stumpf | 30/391 |
| 5,361,501 | 11/1994 | Fajnsztajn | 30/391 |

*Primary Examiner*—Hwei-Siu Payer
*Attorney, Agent, or Firm*—Waddey & Patterson; Edward D. Lanquist, Jr.

[57] ABSTRACT

The present invention discloses an outer debris shield which attaches to the outer arch of the upper guard. This outer debris shield has a forward edge and a rearward edge having a mid point there in between. There is also an attachment edge that generally follows the alignment of the outer arc. Additionally, outer debris shield has a projecting edge which extends away from the upper guard as it approaches mid point. Additionally, the present invention provides an inner debris shield which attaches to the inner base of upper guard.

5 Claims, 3 Drawing Sheets

UNIVERSAL DEVICES FOR PROTECTING THE USER OF A CIRCULAR SAW FROM FLYING DEBRIS

BACKGROUND OF THE INVENTION

The present invention relates generally to carpenter tools and more particularly to a shield for a circular saw.

It will be appreciated by those skilled in the art that debris from circular saws can cause debris control problems in different ways. Initially, the debris can fly up into the unprotected eyes of the user or onto the body of a user thereby causing discomfort and possible injury. Additionally, debris from the circular saw can obfuscate the line that is to be cut. It will be appreciated by those skilled in the art that there are several different types of circular saws with each type of circular saw having a different configuration.

One such attempt to solve the problem relating to debris is disclosed in Applicant's U.S. Pat. No. 5,159,759 issued on Nov. 3, 1992. In that embodiment, a single pieced system is disclosed which can be attached to certain types of circular saws. Unfortunately, the molded bends necessary to create the one piece configuration may fatigue, over time, at the location where the blade shield joined to the fan shield. The different configurations of a verity of saws do not allow for a universal, one piece, debris shield design that can be made to fit several types of saws. Furthermore, the application of the prior art could not be applied as a single piece shield to the Bosch and Skil type saws due, in particular, to the location of the pivot point from which the blade height is adjusted on those particular saws, causing the location at which the fan shield joined to the blade shield to be relocated. Additionally, the different configurations in air discharge of a verity of circular saws, do not allow the saw's fan, with the fan shield in place, to properly discharge air, thereby allowing debris to accumulate and obfuscate the cutting line. For example, on the Skill and Bosch saws, the fan's discharge did not blow debris from the cutting line with the fan shield in place.

What is needed, then, is a system which takes into account the air discharge of various types of skill saws. This needed device must also be capable of being attached to a variety of skill saws. This needed system must be more economical to make. This needed system is presently lacking in the prior art.

SUMMARY OF THE INVENTION

The present invention discloses an outer debris shield which attaches to the outer arch of the upper guard. This outer debris shield has a forward edge and a rearward edge having a mid point there in between. There is also an attachment edge that generally follows the alignment of the outer arc. Additionally, outer debris shield has a projecting edge which extends away from the upper guard as it approaches mid point. Additionally, the present invention provides an inner debris shield which attaches to the inner base of upper guard, thereby providing protection to the operator from debris emitted on the left side of the blade and still allowing visibility to the cutting line while allowing air discharge from the fan to keep debris from building up and thus obfuscating the cutting line.

Accordingly, one object of the present invention is to provide a universal system that can be applied to any skill saw.

A still further object of the present invention is to provide a device which is more economical.

A further object of the present invention is to provide a device which takes proper advantage of the air created by both the fan motor and the rotating blade.

DESCRIPTION OF THE PREFERRED EMBODIMENT

Figure 1:
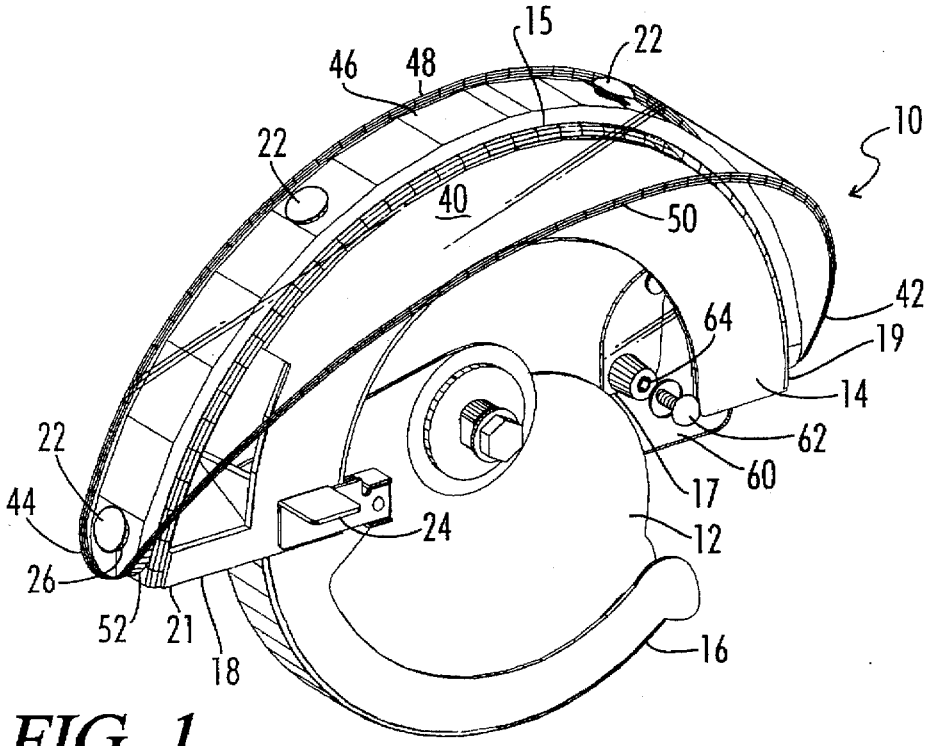
FIG. 1 is a perspective view of a rotary hand saw having the device of the present attachment attached to it.

Referring now to FIG. 1, there is shown generally at 10 the universal device for protecting user of a circular saw from flying debris. Device 10 attaches to saw 12. Saw 12 has upper guard 14 which partially encircles blade (20 in FIG. 2). Upper guard has outer arch 15 and inner base 17. Lower guard 16 also has blade guard handle 24. Upper guard 14 has leading edge 19 and trailing edge 21. Proximal leading edge 19 there is inner base 17. Proximal trailing edge 21 there is guide 18. In the present device, holes (25 in FIG. 2) are placed in upper guard 14. Snap holders 26 are attached to upper guard 14. In the preferred embodiment, backing 52 is attached to outer debris shield 40. In the preferred embodiment, backing 52 has an adhesive which aids in the attachment to the debris shield 40. In the preferred embodiment, outer debris shield 40 has forward edge 42 and rearward edge 44. In between forward edge 42 and rearward edge 44 there is midpoint 46. Attachment edge 48 of debris shield 40 generally follows upper guard 14 whereas projecting edge 50 extends away from upper guard as outer debris shield approaches midpoint 46. Inner shield 60 attaches to inner base 17 using screw 62 placed in orifice 64. The use of this configuration generally creates the necessary vortex which allows debris to be blown away from cutting line.

Figure 2:
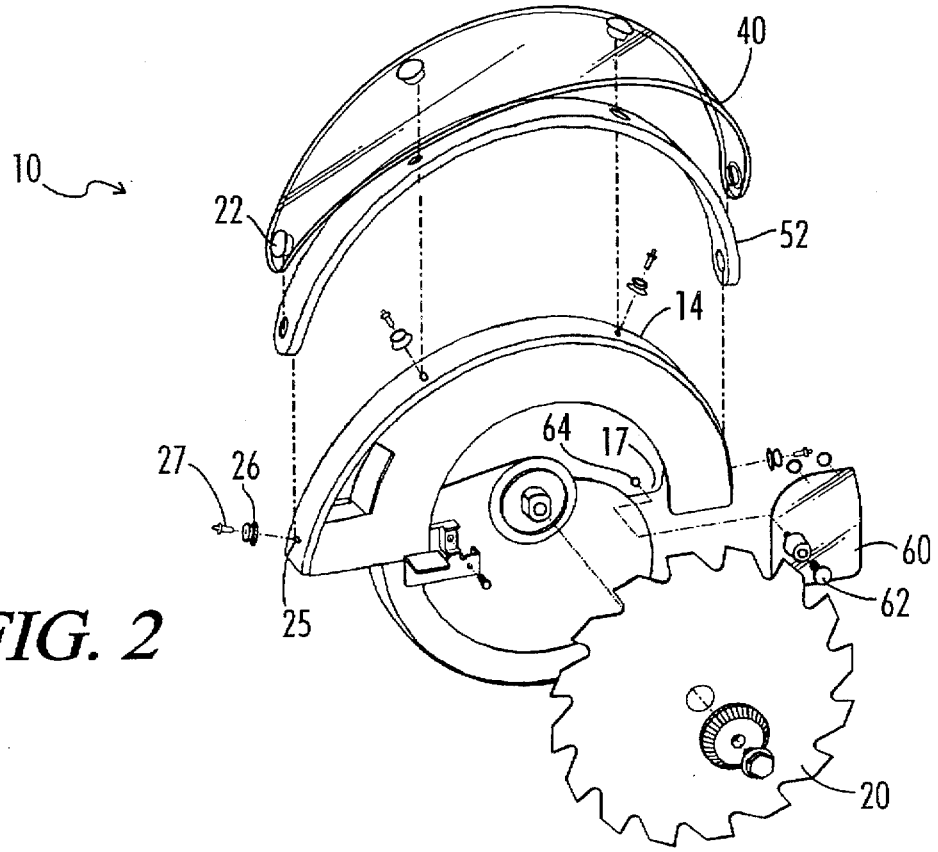
FIG. 2 is an exploded view of a rotary hand saw having the device of the present attachment attached to it.

Referring now to FIG. 2, there is shown generally at 10 the same embodiment shown in FIG. 1. As can be seen, outer shield 40 attaches to upper guard 14. Inner shield 60 attaches to inner base 17. FIG. 2 also shows blade 20 being partially encircled by upper guard 14. FIG. 2 also shows placement of snaps 22, snap holders 26, and holes 25. In the preferred embodiment, snap holders 26 are held in place by drive pins 27.

Figure 3:
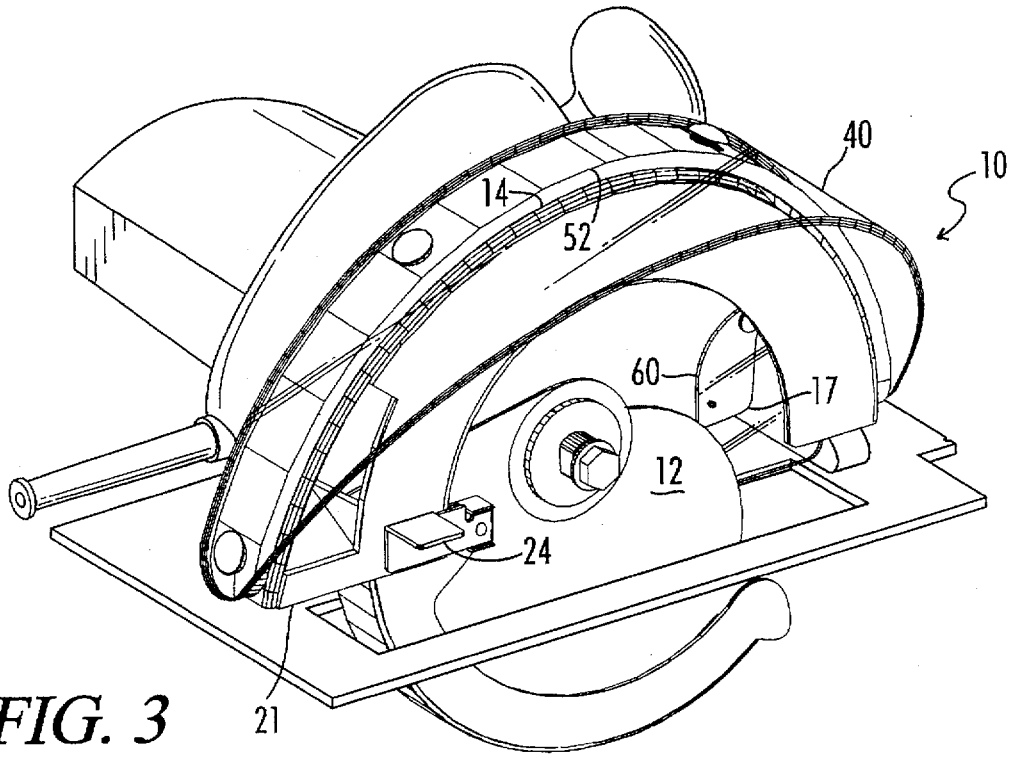
FIG. 3 is a perspective view of a rotary hand saw skill saw having the device of the present attachment attached to it.
Figure 4:
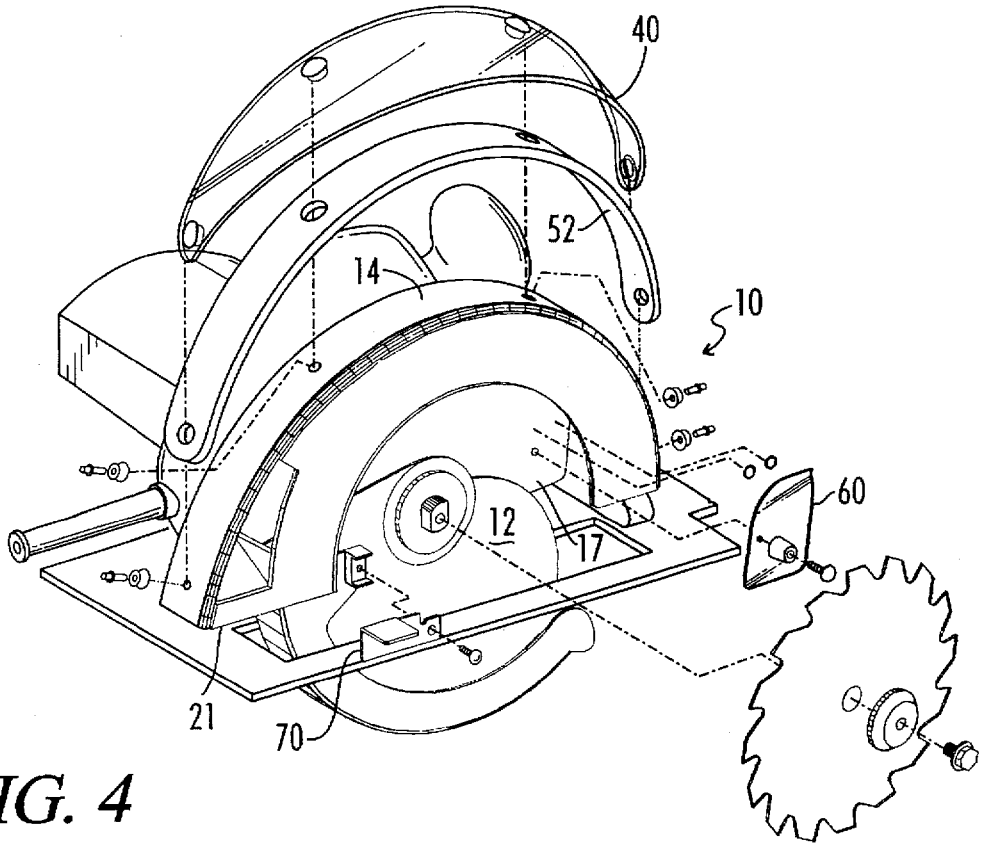
FIG. 4 is an exploded view of the device of the present invention showing the auxiliary handle necessary to make the present invention work in connection with a rotary hand saw.

Referring now to FIGS. 3 and 4, there is shown generally at 10 the device of the present invention used in connection with a rotary hand saw. As can be seen, replacement or auxiliary handle 70 must be added to allow rotary hand saw 12 to work efficiently. Guard handle 24 is attached to lower guard 16 proximal trailing edge 21. As can be seen, outer shield 40 attaches to upper guard 14. Also, inner shield 60 attaches to inner base 17.

In the preferred embodiment, outer debris shield 40 from forward edge 42 to rearward edge 44 is approximately 15¼" long for 7¼" saws and 16⁵⁄₁₆" long for 8¼" saws. Snaps 22 are placed approximately 14⅝" apart for 8¼ saws and 13 9/16" apart for 7¼ saws. At forward edge 42 and rearward edge 44, raise of curvature is approximately 4 inches. At midpoint 46, the distance between attachment edge 48 and projection edge 50 is approximately 4 inches. In the preferred embodiment, inner shield 60 is substantially rectangular with a curved upper left corner. In the preferred embodiment, inner shield 60 and outer shield 40 are made of polycarbonate.

Figure 5A:
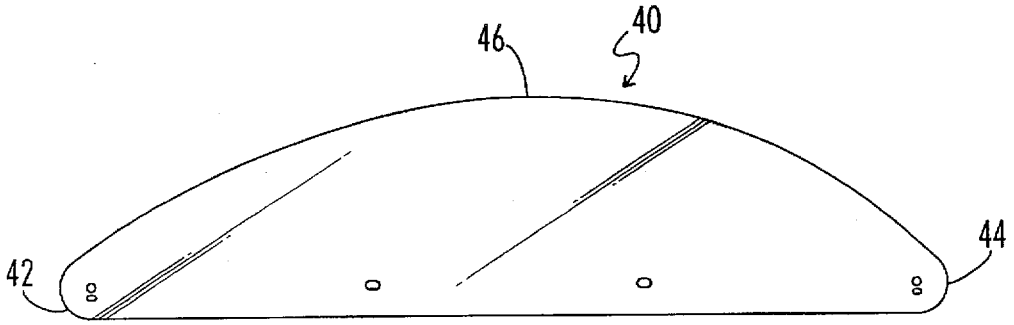
FIGS. 5*a* and 5*b* are plan views of the outer debris shield of the preferred embodiment.

Referring now to FIG. 5*a* there is shown generally at 40 the upper shield for an 8¼" saw of the present invention. Upper shield 40 in FIG. 5*a* can be used in connection with saws manufactured by companies such as Hitashi, Ryohi, Dewalt and Black & Decker, and others. Referring now to FIG. 5*a* there is shown generally at 40 the outer debris shield of the present invention. Outer debris shield 40 has forward section 42 and rearward section 44. Forward section 42 and rearward section 44 have radius of curvature of substantially 9/16" and are substantially 16 5/16" apart. At midpoint 46, shield is substantially 4 inches wide and has a radius of curvature of substantially 15".

Figure 5B:
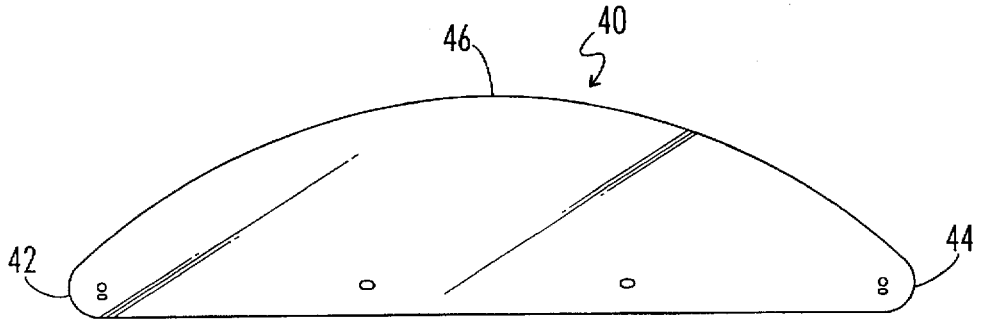

Referring now FIG. 5*b*, there is shown generally at 40 the upper debris shield of the present invention which is used in connection with a 7¼" saw. Forward edge 42 and rearward edge 44 are substantially 15¼" apart. Midpoint 44 is substantially 4 inches wide and has a radius of curvature of substantially 10⅝". In the preferred embodiment, all shields are made of 1/16" polycarbon.

Figure 6A:
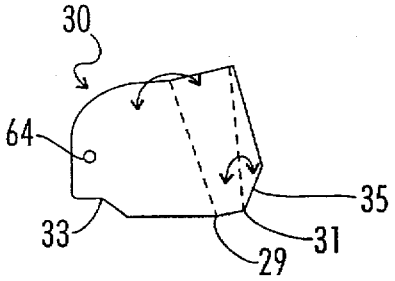
FIGS. 6*a*–6*d* are plan views of various inner debris shields of the present invention.

Referring now to FIG. 6*a*, there is shown generally at 30 the inner shield of the present invention when used on a Black & Decker 8¼" saw cat. Inner shield 30 has initial bend 29 of substantially 14° and second bend 31 which is substantially 29°. Inner shield is substantially 3 7/16" wide at its widest point and 2⅞" at its tallest point. Inner shield has lower left notch 33 and lower right notch 35. Lower shield 30 also has orifice 64 which is preferably ¼" in diameter.

Figure 6B:
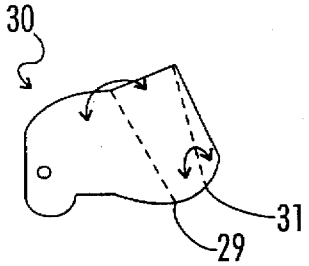

Referring now to FIG. 6*b*, there is shown generally at 30 the inner shield of a Black & Decker 8¼" Super Sawcat. Preferably, first bend 29 is substantially 12° whereas second bend 31 is substantially 27°. At its tallest point, inner shield is substantially 2⅞" tall and its widest point is substantially 3⅝" wide.

Figure 6C:
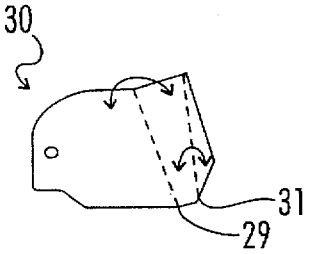

Referring now to FIG. 6*c* there is shown generally at 30 the inner shield for a 7¼" Sawcat. First bend 29 is substantially 20° whereas second bend 31 is substantially 27°. Lower shield 30 is substantially 3¼" wide and 2⅞" tall.

Figure 6D:
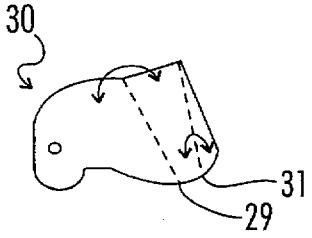

Referring now to FIG. 6*d*, there is shown generally at 30 the lower shield of a 7¼" Super Sawcat. First bend 29 is substantially 17° whereas second bend 31 is substantially 25°.

Thus, although there have been described particular embodiments of the present invention of a new and useful universal device for protecting the user of a circular saw from flying debris, it is not intended that such references be construed as limitations upon the scope of this invention except as set forth in the following claims. Further, although there have been described certain dimensions used in the preferred embodiment, it is not intended that such dimensions be construed as limitations upon the scope of this invention except as set forth in the following claims.

What we claim is:

1. A universal device for protecting user of a circular saw from debris wherein said circular saw having a blade and an upper guard partially encircling said blade, said upper guard having an outer arch and an inner base, said device comprising:

a. an outer debris shield having a forward edge distal a rearward edge and a midpoint between said forward edge and said rearward edge, said outer debris shield having an attachment edge and a projecting edge wherein said projecting edge extending away from said attachment edge proximal said midpoint;

b. means for attaching said outer debris shield to said outer arch;

c. an inner debris shield; and means for attaching said inner debris shield to said inner base.

2. The device of claim 1 wherein said means for attaching said outer debris shield to said outer arch comprises snaps.

3. The device of claim 1 wherein said means for attaching said inner debris shield to said inner base comprises a bolt.

4. The device of claim 1 further comprising a backing attached to said outer debris shield between said upper guard and said outer debris shield.

5. The device of claim 1 wherein said outer debris shield is approximately four inches from said attachment edge to said projecting edge proximal said midpoint.

* * * * *